US006955070B2

(12) United States Patent
Schult et al.

(10) Patent No.: US 6,955,070 B2
(45) Date of Patent: Oct. 18, 2005

(54) DEVICE FOR PUNCHING WORK PIECES IN AN INTERNAL HIGH-PRESSURE FORMING TOOL

(75) Inventors: Jens Schult, Stelle-Ashausen (DE); Stefan Schwarz, Luenen (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/873,645

(22) Filed: Jun. 23, 2004

(65) Prior Publication Data

US 2005/0016238 A1 Jan. 27, 2005

(30) Foreign Application Priority Data

Jun. 25, 2003 (DE) ..... 103 28 454

(51) Int. Cl.[7] ..... B21D 28/28; B21D 9/15; B21D 26/02

(52) U.S. Cl. ..... 72/55; 72/56; 72/57; 72/63; 83/54; 29/421.1

(58) Field of Search ..... 29/421.1; 72/55, 72/56, 57, 58, 63; 83/54

(56) References Cited

U.S. PATENT DOCUMENTS 4,315,425 A * 2/1982 Zbornik et al. ..... 72/481.2
4,612,796 A * 9/1986 Smyth, Jr. ..... 72/462
4,691,554 A * 9/1987 Murphy ..... 72/481.2
5,398,533 A 3/1995 Shimanovski et al.
6,067,830 A * 5/2000 Klages et al. ..... 72/55
6,341,514 B2 * 1/2002 Engel et al. ..... 72/55
6,439,018 B1 * 8/2002 Hellgren et al. ..... 72/55
6,442,820 B1 * 9/2002 Mason ..... 29/421.1
6,662,611 B2 * 12/2003 Janssen et al. ..... 72/55

FOREIGN PATENT DOCUMENTS

DE 19752171 A1 6/1998

* cited by examiner

*Primary Examiner*—David Jones
(74) *Attorney, Agent, or Firm*—Crowell & Moring LLP

(57) ABSTRACT

A device for punching work pieces in an internal high-pressure forming tool includes a punching die guided displaceably in a bore of the forming tool. The device also contains a drive with which the punching die is moved back and forth between the in-use position and the non-use position. In order to facilitate, in a simple and space-saving manner, the punching of work pieces in the internal high-pressure forming tool, the drive contains a pressure fluid and a pressure transfer device that can be elastically expanded via the pressure fluid between a base firmly attached to the tool and a punch head of the punching die. The pressure transfer device abuts a partition at least indirectly at the punch head.

21 Claims, 5 Drawing Sheets

DEVICE FOR PUNCHING WORK PIECES IN AN INTERNAL HIGH-PRESSURE FORMING TOOL

This application claims the priority of German application 103 28 454.0, filed Jun. 25, 2003, the disclosure of which is expressly incorporated by reference herein.

BACKGROUND AND SUMMARY OF THE INVENTION

The present invention concerns a device for punching work pieces in an internal high-pressure forming tool including a punching die that is guided displaceably in a bore, and a drive with which the punching die can be moved back and forth between an in-use position and a non-use position.

A device of this type is known from U.S. Pat. No. 5,398,533. The device described there contains a punching die that is integrated in the internal high-pressure forming tool. The punching die, which can move back and forth in a bore, is supported on the rear side by a wedge-shaped surface of a slide that can be driven manually or automatically and that is displaceable transverse to the movement direction of the punching die. In order to move the punching die in its bore, the slide must be constantly moved back and forth, so that the punching die moves up and down along the wedge surface of the slide. Based on the internal pressure that is applied on the slide via the punching die and that exists in the hollow profile to be punched, the sliding surfaces of the rear side of the punching die and the wedge surface of the slide rubbing against each other wear down relatively quickly during use of the punching die and the slide, Furthermore, the response time of the slide for its displacement path is rather long and impedes the quick completion of the punching process and, therefore, the efficient manufacturing process of the hollow profile to be punched.

In addition, a significant construction space must be provided for the forming tool to be able to place the slide. Often, however, such space is not available, because of the tightly dimensioned accommodation in the tool and/or due to complex processes of the tool form.

As a rule, a hydraulic cylinder is used today for driving a punching die, as is depicted, for example, in German document DE 197 52 171 A1. These very cost-intensive hydraulic cylinders are installed into forming tools, whereby appropriate recesses must be provided, creating large machining operation expenditures. These recesses also lead to a significant weakening of the stability of otherwise solid forming tools. Based on the high tension in a forming tool created by the internal high pressure, such weaknesses can lead to the destruction of the tool. In addition, the use of hydraulic cylinders presupposes corresponding costly control engineering.

One object of the invention is to develop a device as mentioned above in such a way that the punching of work pieces in the internal high-pressure forming tool is enabled in a simple and space-saving manner.

This object is achieved according to the invention by having the drive include a pressure fluid and a pressure transfer device that is elastically expandable via the pressure fluid between a base firmly attached to the tool and a punch head of the punching die, with the pressure transfer device having a partition which at least indirectly abuts the punch head.

By designing the drive for the punching die in the form of a pressure transfer device and a pressure fluid such that the pressure transfer device is elastically expandable according to the invention, the drive can be built having a conceivably small volume. Just an elastic de-location of a partition of the pressure transfer device is necessary for actuating the punching die, with the partition in effective contact with the punch head. The pressure transfer device hardly uses any space in the forming tool, particularly in a non-use position. In addition, the pressure fluid energizing the pressure transfer device can be led via channel-type pipelines that can be designed, as desired and according to constructive tool conditions in the forming tool, so that the pipelines only require very little space. An elastic pressure transfer device can be manufactured with simple methods and placed in the forming tool at the punching die while the pipelines required for the pressure fluid can be incorporated without great expenditure in the forming tool. In order to reduce the device expenditure and in order to make the process more economical, a single pressure fluid can actuate simultaneously several punching dies located in the forming tool via the appropriate pressure transfer devices. In addition, it is possible to punch work pieces at places that are otherwise hard or impossible to reach due to the small dimensions of the device according to the invention. Due to the small space requirements for the device according to the invention, the recesses provided for accommodation of the device can be small so that the forming tool, in total, is only minimally weakened with respect to its solid structure. Thus, the internal high-pressure-induced stress produced during the forming process in the tool can be absorbed without any damage by the forming tool. Furthermore, due to the smaller dimensions in reference to the hydraulic cylinders and slides of the pressure transfer devices, more punching dies can be integrated into the forming tool, as the axial distance of the punching dies only depends on the design of the punching dies. The additional punching options that are gained this way can expand advantageously the variety of work pieces that can be manufactured.

According to certain features of the invention, the punching die is equipped with a compression spring that is supported on the one hand by the bottom of the punch head and on the other hand by the section of a first stepped expansion of the bore. In principle it is conceivable according to the invention that the pressure transfer device is connected with the punch head via its partition in such a way that the punching die is lifted or lowered according to the fluid pressure through expansion or contraction of the pressure transfer device. Here, however, it is not guaranteed that the punching die in a non-use position is always flush with its punching front with the cavity of the forming tool. Undesired impressions and dents can result under certain circumstances on the work piece. In order to assume a defined non-use position that guarantees a flush position of the front of the punching die with the cavity, the compression spring is located at the punching die that sets it back as planned. The punch head is supported then by the pressure transfer device, which assumes a defined position in the forming tool in its non-use position. In order to guarantee the flush position, the prestress of the compression spring must be set appropriately.

According to other features of the invention, the punch head and the pressure transfer device are located within a second stepped expansion of the bore. This layout is designed because of the at least indirect energizing of the pressure transfer design at the punch head. Through a second stepped design, the punching die is given a defined position in the in-use-position, as its bottom can be supported by the section of the expansion step. In order to avoid having the pressure transfer device extrude at the side of the punch head due to the pressure fluid, the diameter of the punch head and the diameter of the expansion must be aligned with each other in such a way that the punch head has play in the expansion that is appropriately reduced.

According to additional features of the invention, the second stepped expansion is intersected by a channel that runs transverse to the expansion and where the pressure transfer device is located. Through the inclusion of the channel, the pressure transfer device can be inserted easily during set-up of the forming tool at the correct destination location and the pressure fluid can be fed without the formation of an additional channel simultaneously via the channel to the pressure transfer device. In addition, the channel running in a transverse direction to the expansion offers support and/or installation surfaces for the pressure transfer device so that it is kept in the prescribed position after its installation. In addition, the pressure transfer device can be exchanged easily via the channel if retooling seems to be required, for example due to signs of wear on the pressure transfer device. Several punching positions can be installed in a space-saving fashion in the forming tool with the appropriate pressure transfer device via this channel, which does not necessarily have to run in a straight line, but can also comprise laterally bent segments and/or height differences. They can be arranged almost anywhere in the forming tool.

According to other features of the invention, the base is formed by a locking plate that is fastened to the forming tool and that covers the channel and/or the expansion towards the exterior. Based on a design that is open at one of the longitudinal sides of the channel, the pressure transfer device(s) can be inserted in a simple fashion into the forming tool. In addition, any desired route of the channel can be incorporated with a high level of precision, for example with milling. The locking plate, which, for example could be screwed to the forming tool, closes the channel at its open longitudinal side. Here the side of the locking plate facing the forming tool forms the base plate for the support of the pressure transfer device. The pressure transfer device can also be attached to this base plate, whereby screws or clamps are conceivable. In any case, the locking plate practically forms a partition of a pressure chamber, in which the pressure fluid is accepted. This means that the pressure fluid can be stressed in the channel and that it remains in the forming tool. In addition, the rigid locking plate prevents expansion of an appropriately formed pressure transfer device to all directions under pressure such that it might explode. Thus, the expansion of the pressure transfer device has a preferred direction, which is the direction of the mobile punching die.

According to additional features of the invention, the pressure transfer device is hollow and contains the pressure fluid, whereby it is connected at least at one end to a controllable high pressure generating system. Using this special pressure transfer device design, the pressure fluid can be guided in a simple and space-saving manner. In addition, the pressure fluid does not wet the forming tool, so that no corrosion occurs on the forming tool. On the other hand, no provisions for sealing the forming tool are necessary, which reduces the design expenditure for the forming tool. Based on the controllability of the high pressure generating system, to which the pressure transfer devices are connected, the pressure of the pressure fluid and, therefore, the degree of the expansion can be fine-tuned to a great extent, which results in further improvement of the process safety during the punching operation.

According to other especially preferred features of the invention, the pressure transfer devices are designed in the form of tubes. In addition to the fact that a pressure transfer device of such a design can be inserted extremely easily in the channel, the tube-shaped design offers the advantage that several punching dies can be controlled with just one pressure transfer device, which drastically reduces the multitude of parts of the device according to the invention. In addition, a tube-shaped pressure transfer device can be easily produced as a segment of a cut-to-length infinite strand with very low costs.

According to other preferred features of the invention, the pressure transfer device is a membrane that is fastened to the base and that is energized with the controlled pressure fluid. In order to guide the pressure fluid, a channel-shaped fluid pipeline is integrated into the forming tool. Due to the surface design of the membrane, an appropriately formed pressure transfer device is even more space-saving than a hollow design of a pressure transfer device.

According to further features, the pressure transfer device directly abuts the punch head with its partition. The number of components according to the invention is further reduced and simplified through the direct energizing of the punch head through the pressure transfer device. This design form is especially space-saving as the intermittent component is foregone.

According to other features, the pressure transfer device is located in a rigid guide rail that abuts the punch head and that is located in the bore with only little tolerance. Due to the location of the pressure transfer device in a rigid guide rail, which only has little tolerance in the bore of the punching die, extrusion of the pressure transfer device, which is under high pressure, at the punch head towards the area of the punch shaft is prevented and no jamming takes place at the punching die that would make it dysfunctional. The energizing process by the pressure transfer device only takes place indirectly due to the layout of the guide rail abutting the punch head.

According to especially preferred features, the supporting area of the guide rail is larger than the punch head surface. Thus, the surface that acts upon the punching die has been enlarged, whereby less pressure must be applied due to the large usable area while keeping the punching power constant. In other words, the same punching power of the punching die can be achieved with lower fluid pressure levels. Due to the lower fluid pressure requirement, the use of smaller-built fluid high pressure generating systems with reduced power is possible without any loss in the process safety of the punching process.

Additional features provide that the guide rail forms the punch head. This in turn enables the direct energizing of the punch head by the pressure transfer device so that another component is omitted, saving space through the integration of the punch head in the guide rail, and so that the advantages of the larger supporting area of the guide rail mentioned are maintained.

According to yet other features of the invention, the punch shaft is attached detachably to the guide rail. If the cutting edge of the punching die is worn, therefore, just the punch shaft or the guide rail can easily be replaced in order to fine tune the amount of punching force exactly with the respective requirements—while the fluid pressure is maintained—via a change in the supporting area of the guide rail.

According to still further features of the invention, the pressure fluid feed line for the drive of the punching die is fluidically coupled with a fluid high pressure generating system for the purpose of generating an internal high pressure to form the work piece. In this way, the supply system of the pressure fluid is significantly simplified by utilizing the fluid high pressure generating system that is used already for forming the work piece and the pressure fluid fed by it via a bypass pipeline.

A process of operating the device is also claimed. The invention is explained in greater detail using examples shown in drawings.

DETAILED DESCRIPTION OF THE INVENTION

Figure 1B:
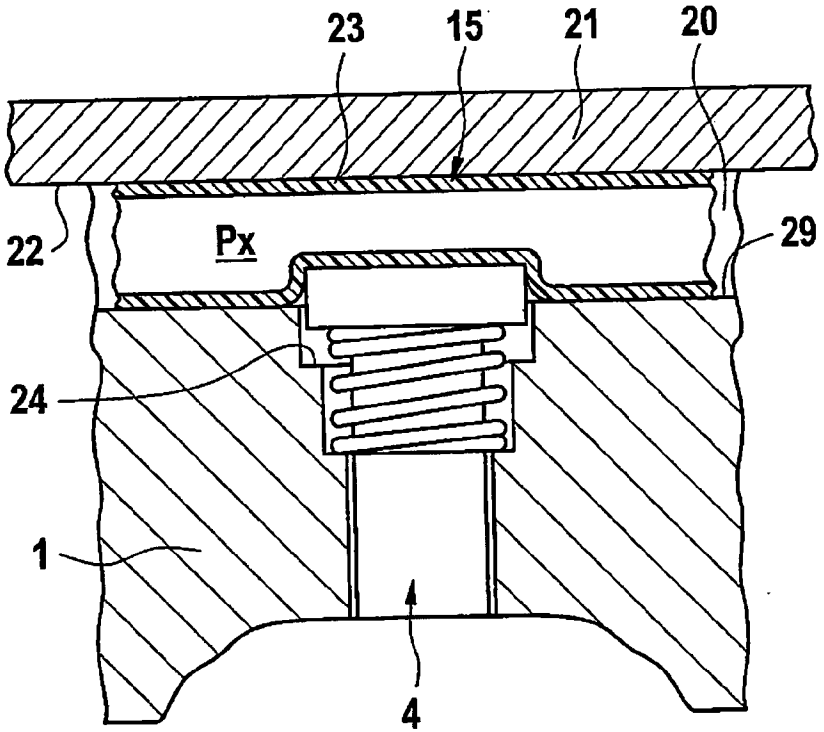
FIG. 1*b* is a side longitudinal sectional view of the device of FIG. 1*a* in a non-use position.
Figure 1A:
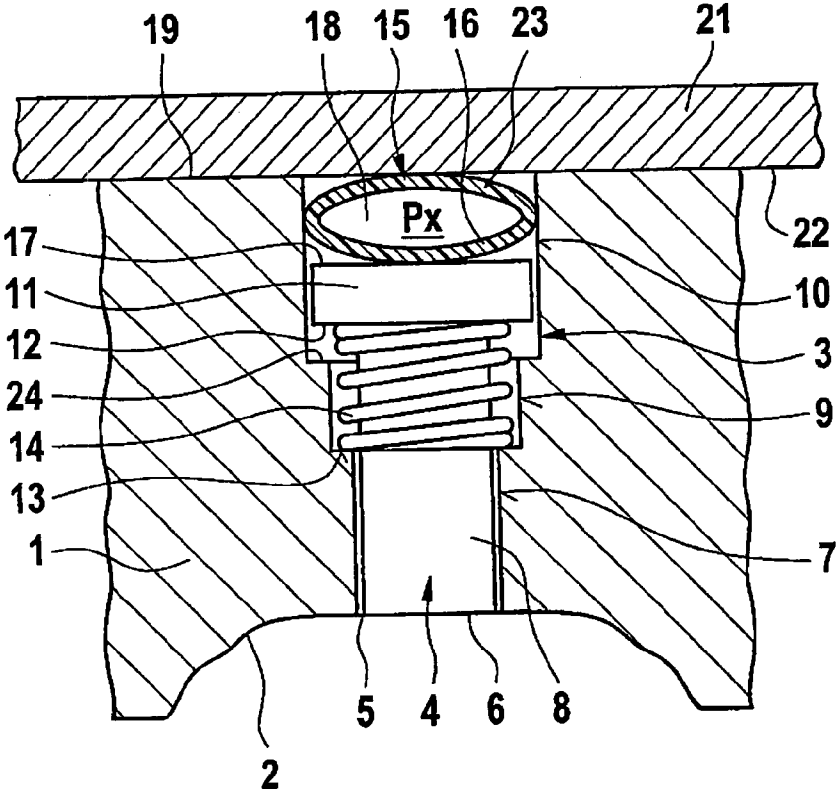
FIG. 1*a* is a cross-sectional view of a device according to the invention with a tube-shaped hollow pressure transfer device that abuts directly the punch head of the punching die in a non-use position.

In FIG. 1*a*, a device is shown for punching work pieces, for example hollow profiles or sheet metal, in an internal high-pressure forming tool, where the upper matrix 1 of the forming tool is shown representatively. The upper matrix 1 forms with its lower front 2 a segment of a cavity that represents the forming area for a work piece to be formed. In the upper matrix 1 a through-bore 3 is included, where a mobile punching die 4 is guided displaceably. In the shown non-use position of the punching die 4 its face 6 containing a cutting edge 5 abuts the lower front 2 of the upper matrix 1 in a flush manner. In the first segment 7 close to the cavity of the through-bore 3 a punch shaft 8 of the punching die is inserted with a tolerance. Next to the segment 7 a first stepped expansion 9 of the bore 3 follows in the outward direction. The first stepped expansion 9 of the bore 3 merges into a second stepped expansion 10, where the punch head 11 of the punching die 4 is arranged with a tolerance. At its bottom 12 and at the section 13 of the first stepped expansion 9 a pressure spring 14 is supported. In the second stepped expansion 10 a pressure transfer device 15 is located that abuts the lower partition 16 directly at the upper side 17 of the punch head 11. The pressure transfer device 15 is designed in the form of a tube and has a hollow space 18 that contains the pressure fluid having the pressure $P_x$. The pressure transfer device 15 is elastically expandable and preferably consists of an elastomer. As can be seen in particular in FIG. 1*b*, the upper front 19 of the upper matrix 1 includes a channel 20 that intersects the second stepped expansion 10 and runs in a transverse direction to it, whereby the pressure transfer device 15 is located in the channel 20. The second stepped expansion 10 and the channel 20 are covered upwards by a locking plate 21 that rests on the upper front 19 of the upper matrix 1 to which it is fastened. The locking plate 21 forms with its bottom a base 22, forming the support of the upper partition area 23 of the pressure transfer device 15. Between this base 22 and the upper side 17 of the punch head 11 the pressure transfer device can be expanded elastically, As can be seen in FIG. 1*b*, the punch head 11 in a non-use position of the punching die 4 presses the pressure transfer device 15 that is driven by the restoring prestress of the compressing spring 14 inward as the pressure fluid within the pressure transfer device 15 only has little pressure or no pressure at all in a non-use position.

Figure 2B:
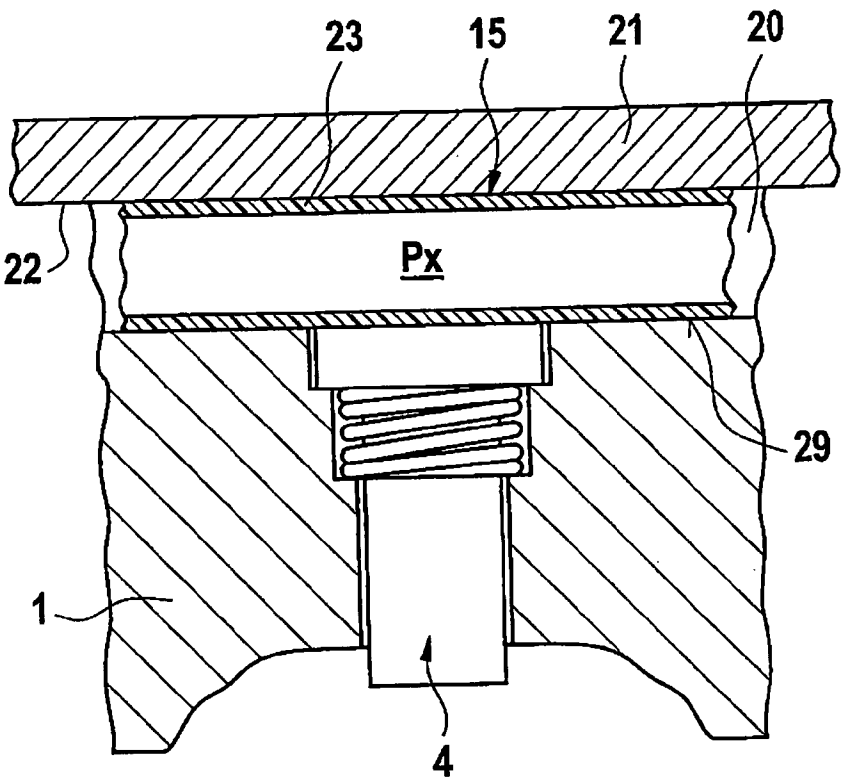
FIG. 2*b* shows the device of FIG. 1*a*, in a side longitudinal section, in the in-use position of the punching die.
Figure 2A:
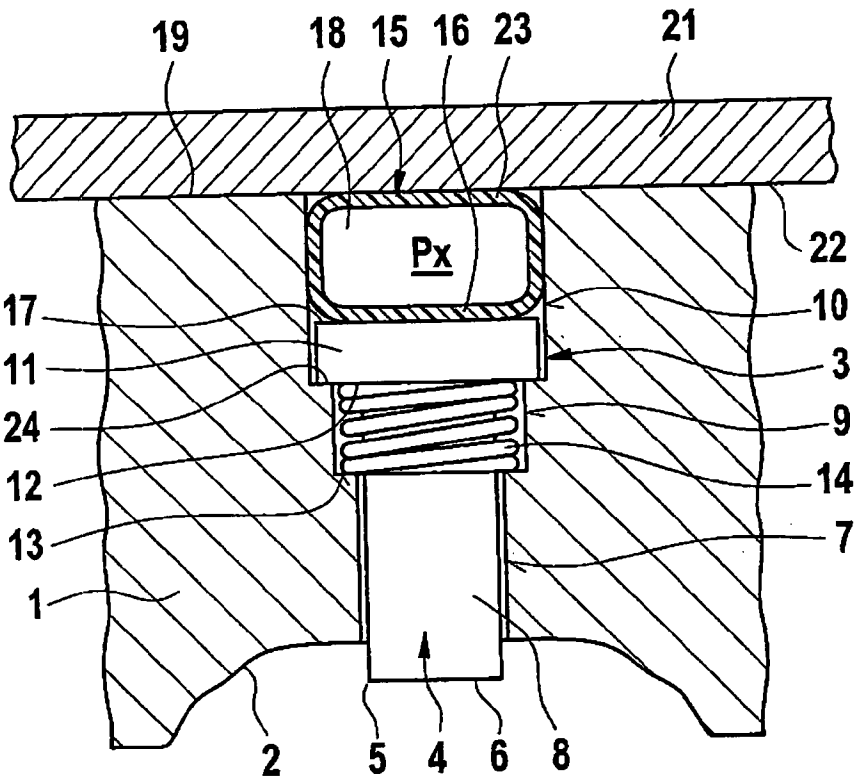
FIG. 2*a* is a cross-sectional view of the device according to FIG. 1*a* in an in-use position.

If the internal high-pressure forming tool is closed and there is an internal high pressure in its cavity that has already formed the work piece as desired, then the punching process takes place with the punching die 4. Here the pressure fluid located in the pressure transfer device 15 is energized via the high pressure generating system that is connected with at least one end to the pressure transfer device 15, and the pressure that is required for the punching process is controlled by above mentioned devices. Consequently, according to FIG. 2*a* or FIG. 2*b*, the pressure transfer device 15 is expanded by the increased fluid pressure $P_x$, whereby its hollow space 18 is enlarged and its lower partition 16 presses the punching die into the cavity. The inward movement of the punching die 4 takes place until the bottom 12 of the punch head 11 reaches a section 24 of the second stepped expansion 10. The compression spring 14 is squeezed together. The in-use position of the punching die 4 has now been reached, and the punching process has been completed, whereupon the pressure fluid is de-energized and the punching die 4 is pushed into its non-use position by the compression spring 14. In the described embodiment the drive is formed only by the pressure transfer device 15 and the pressure fluid.

Figure 3B:
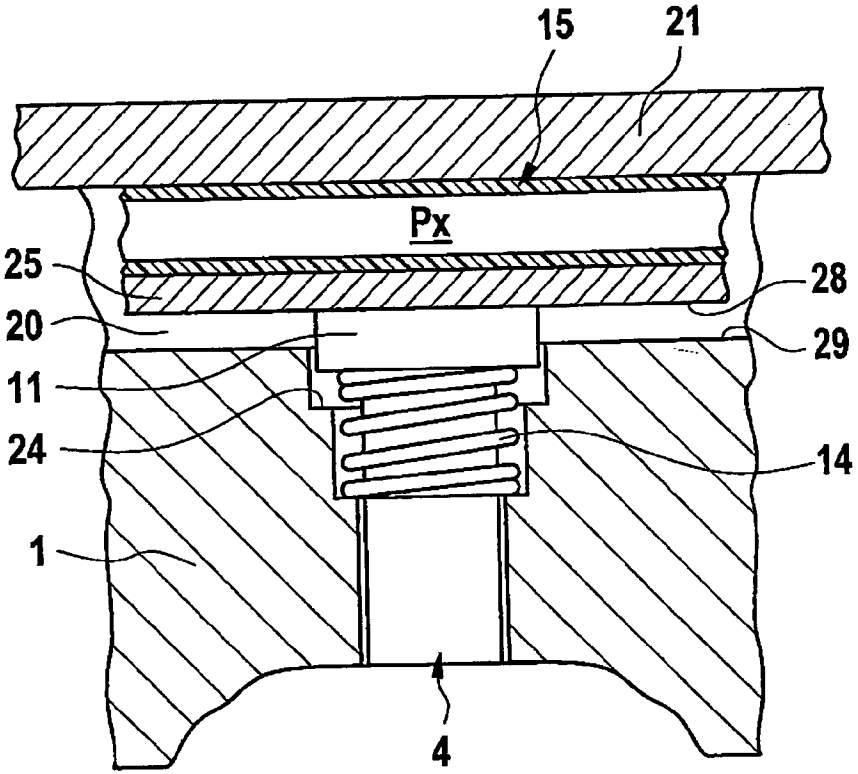
FIG. 3*b* is a side longitudinal sectional view of the device of FIG. 3*a* in a non-use position.
Figure 3A:
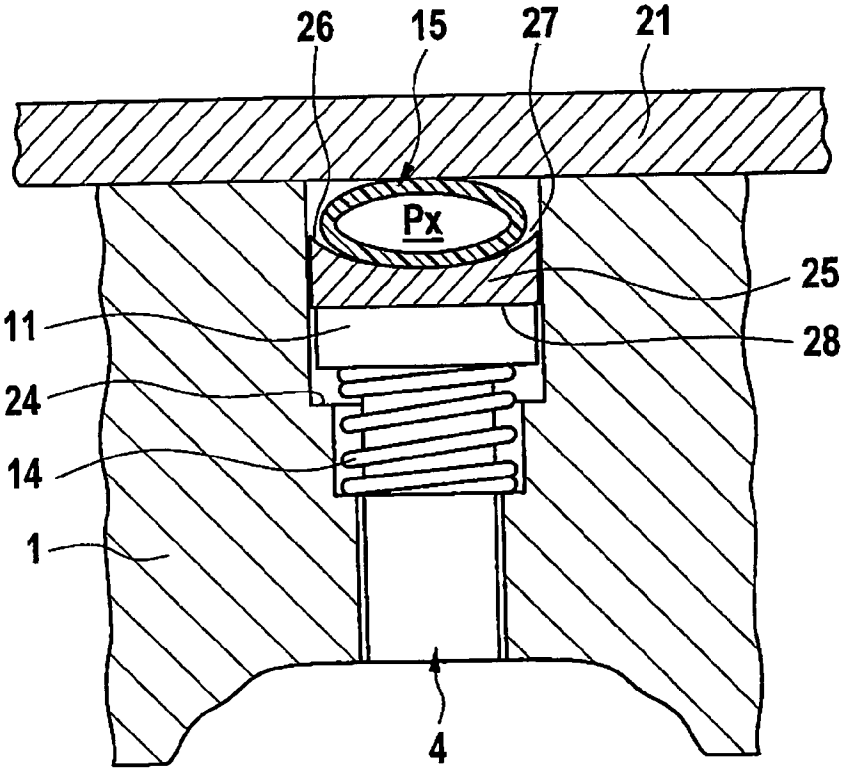
FIG. 3*a* is a cross-sectional view of a device according the invention with a guide rail as an intermittent component between the pressure transfer device and the punch head of the punching die.
Figure 4B:
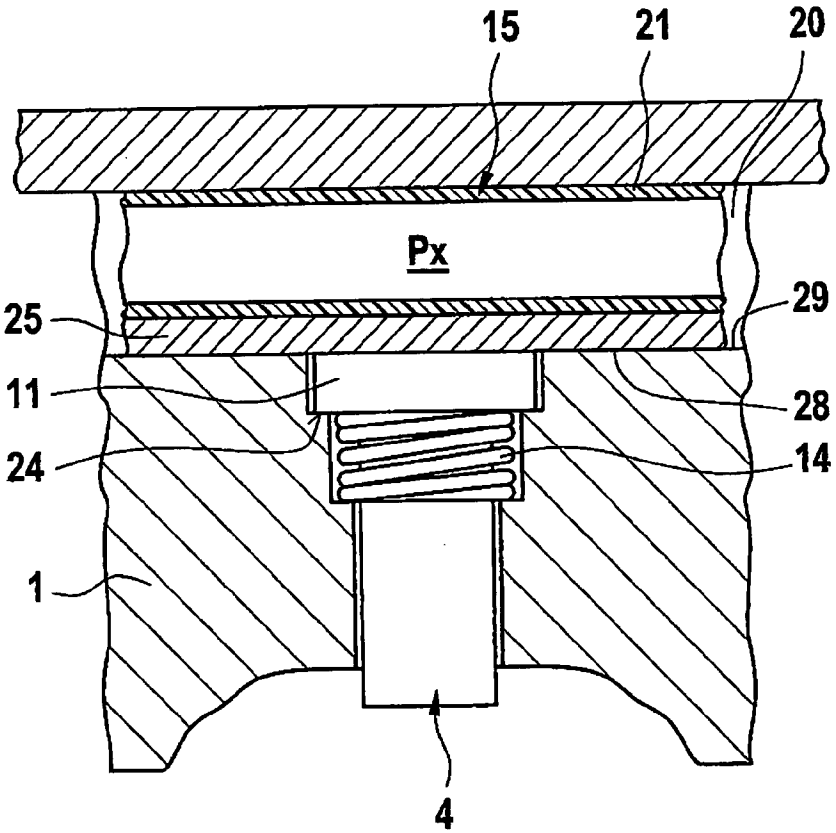
FIG. 4*b* shows the device of FIG. 3*a*, in a side longitudinal view, in the in-use position of the punching die.
Figure 4A:
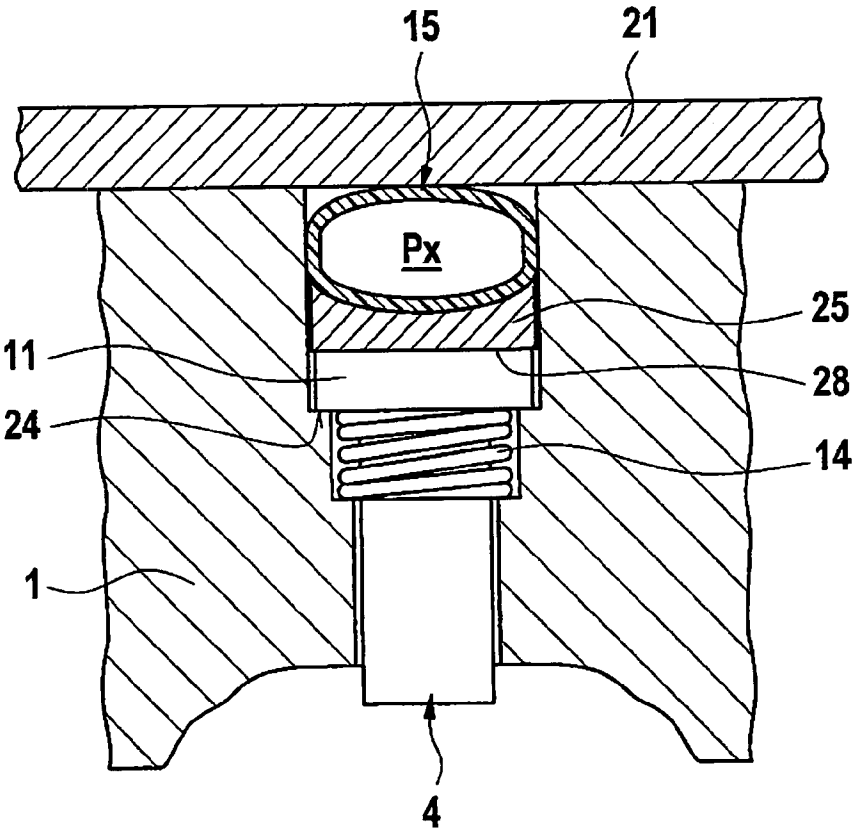
FIG. 4*a* shows the device according to FIG. 3*a* in a cross-sectional presentation in the in-use position of the punching die.

FIGS. 3*a* and 3*b* or 4*a* and 4*b* represent a variant of the above embodiment of the invention. Here the drive of the punching die 4 also contains a guide rail 25. The tube-shaped pressure transfer device 15 is located in the rigid guide rail 25, whereby the guide rail 25 has an accommodation depression 27 on its upper side 26. The guide rail 25 is located within the second stepped expansion 10 of the through-bore 3 with little tolerance. This and the concavity of the accommodation depression 27 prevent the extrusion of the flexible pressure transfer device 15 beneath the bottom 12 of the punch head 11 in the case of a highly energized pressure fluid. The guide rail 25 rests with its bottom 28 against the upper side 17 of the punch head 11 so that the pressure transfer device 15 can now energize directly the punching die 4. FIGS. 1*a* and 1*b*, as well as FIGS. 3*a* and 3*b*, show non-use positions of the punching dies 4. The guide rail 25 is also located in the channel 20, like the pressure transfer device 15, whereby the guide rail 25 carries the pressure transfer device 15 only over a partial segment of the channel 20. As can be seen in FIG. 3*b*, the guide rail 25 is dimensioned in such a way that its supporting area is larger than the surface of the punch head 11. Thus, lower fluid pressures can be used for a constant punch power of the punching die 4 or significantly higher punch powers can be used with a constant fluid pressure. An additional difference with respect to the previous embodiment is that the punching die 4, in the non-use position of the punching die 4 according to FIGS. 3*a* and 3*b*, is not pressed into the pressure transfer device 15. Thus, the wear is minimized. If a high fluid pressure $P_x$ is used for the punching process according to FIGS. 4*a* and 4*b*, the punching die 4 is pressed with its cutting edge 5 into the cavity of the forming tool. The end position of the in-use position has been reached when the guide rail 25 rests against the bottom 29 of the channel 20 as can be seen in FIG. 4*b*.

Figure 5:
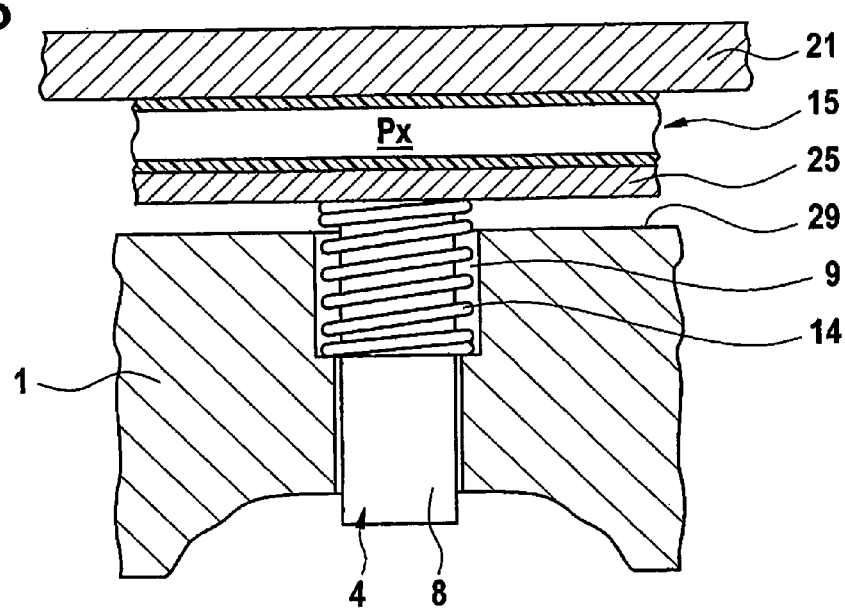
FIG. 5 shows a device according to the invention, in a side longitudinal section, with a pressure transfer device in a guide rail that is fastened to the punch shaft but is detachable.

In FIG. 5, an additional embodiment of the invention can be seen. In a modification from the previous embodiment, the punch head 11 of the punching die 4 is integrated into the guide rail 25. This leads on the one hand to a longer compression spring 14 and on the other hand to the elimination of the second stepped expansion 10 of the through-bore 3. Thus, the design of the upper matrix 1 and its machining process are significantly simplified. In addition, the punch shaft 8 is fastened detachably to the guide rail 25, facilitating the easy use of screw or clamp connections. Incidentally the channel 20 does not intersect the second stepped expansion 10 but, instead, the first stepped expansion 9. Due to the elimination of the second stepped expansion, the upper matrix 1 can be built smaller, so that in total the internal high-pressure forming tool becomes more compact and saves space.

Figure 6:
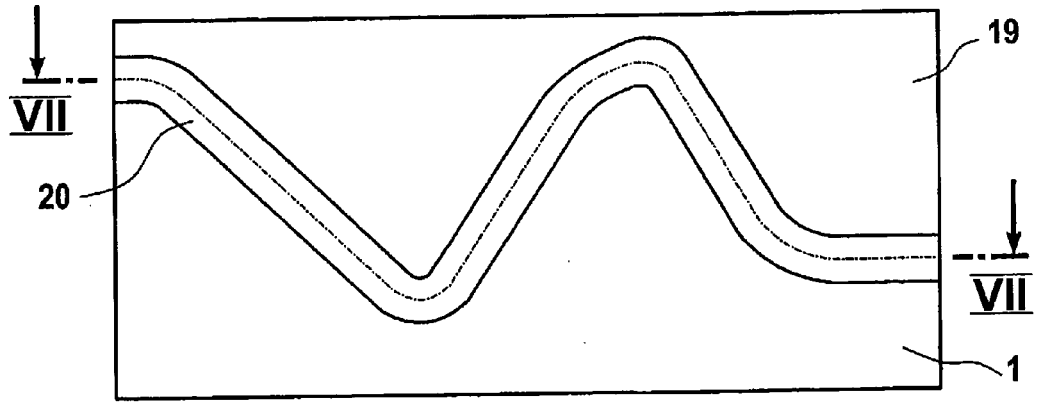
FIG. 6 is a schematic top view of the course of a channel for the device according to the invention in an internal high-pressure forming tool.
Figure 7:
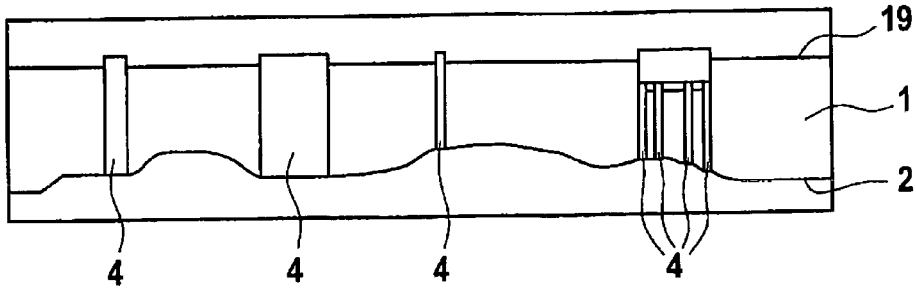
FIG. 7 is a view of the forming tool of FIG. 6 in a section along line VII—VII with several differently designed punching dies.

FIG. 6 shows a top view of the upper matrix 1, in which a winding course of the channel 20 is depicted. A tube-shaped pressure transfer device 15, which extends along the length of the whole channel 20, can be easily inserted into the channel 20. Several punching stations that are dispersed over the surface of the upper matrix 1 can be reached with a single pressure transfer device 15, or the pressure transfer device 15 can activate the punching dies 4 in the punching stations. The punching dies 4 do not have to have the same design, as can be seen in FIG. 7. The punching dies 4 are only shown schematically here. Due to the punch sizes produced by the different punching dies, and because of the different punch forces required, it might be necessary for a unified punching process to provide guide rails 25 that are adjusted individually in size to each punching die 4.

It is useful within the framework of the invention to fluidically couple the pressure fluid supply for the drive of the punching die 4 with the fluid high pressure generating system, which is also used to apply the internal high pressure for forming the work piece. In addition, bellows might be conceivable instead of a tube shaped pressure transfer device. An additional alternative would be the design of the pressure transfer device 15 as a membrane that is fastened to the base 22, requiring only a very small pressure transfer device 15. In order to energize the membrane with pressure fluid in a controlled fashion, a channel-shaped fluid pipeline is integrated in the forming tool, for example in the locking plate 21, so that the pressure fluid is guided via said pipeline.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A device for punching work pieces in an internal high-pressure forming tool comprising:

a punching die that is guided displaceably in a bore, and a drive with which the punching die can be moved back and forth between an in-use position and a non-use position, wherein the drive includes a pressure fluid and a pressure transfer device that is elastically expandable via the pressure fluid between a base firmly attached to the tool and a punch head of the punching die, and wherein the pressure transfer device has a partition which at least indirectly abuts the punch head.

2. The device according to claim 1, wherein the punching die is equipped with a compression spring that is supported on one side by a bottom of the punch head and on another side by a section of a first stepped expansion of the bore.

3. The device according to claim 2, wherein the punch head and the pressure transfer device are located within a second stepped expansion of the bore.

4. The device according to claim 3, wherein the second stepped expansion is intersected by a channel that runs transverse to the expansion and in which the pressure transfer device extends.

5. The device according to claim 4, wherein the base is formed by a locking plate which is fastened to the forming tool and covers at least one of the channel and the expansion.

6. The device according to claim 5, wherein the pressure transfer device is hollow and is connected at least at one end to a controllable high pressure generating system that contains the pressure fluid.

7. The device according to claim 6, wherein the pressure transfer device is designed in a tube shape.

8. The device according to claim 1, wherein the pressure transfer device is a membrane which is fastened to the base, and wherein a channel-shaped fluid pipeline is integrated into the forming tool via which the membrane is energized in a controlled fashion with the pressure fluid.

9. The device according to claim 1, wherein the pressure transfer device abuts the punch head directly with its partition.

10. The device according to claim 1, wherein the pressure transfer device is accommodated in a rigid guide rail that rests on the punch head and is located in the bore with only little tolerance.

11. The device according to claim 10, wherein the guide rail is larger than a surface of the punch head.

12. The device according to claim 1, wherein the pressure transfer device is accommodated in a rigid guide rail that forms the punch head and is located in the bore with only little tolerance.

13. The device according to claim 12, wherein a punch shaft of the punching die is detachably fastened to the guide rail.

14. The device according to claim 1, wherein a pressure fluid supply for driving the punching die is coupled fluidically with a fluid high pressure generating system for production of an internal high pressure that forms the work piece.

15. The device according to claim 2, wherein the pressure transfer device abuts the punch head directly with its partition.

16. The device according to claim 3, wherein the pressure transfer device abuts the punch head directly with its partition.

17. The device according to claim 2, wherein the pressure transfer device is accommodated in a rigid guide rail that rests on the punch head and is located in the bore with only little tolerance.

18. The device according to claim 3, wherein the pressure transfer device is accommodated in a rigid guide rail that rests on the punch head and is located in the bore with only little tolerance.

19. The device according to claim 2, wherein the guide rail is larger than a surface of the punch head.

20. The device according to claim 3, wherein the guide rail is larger than a surface of the punch head.

21. A process of operating a device for punching work pieces in an internal high-pressure forming tool comprising guiding a punching die displaceably in a bore while moving the punching die back and forth between an in-use position and a non-use position by way of a pressure fluid and a pressure transfer device that is elastically expandable via the pressure fluid between a base firmly attached to the tool and a punch head of the punching die and that has a partition which at least indirectly abuts the punch head.

* * * * *